United States Patent [19]

Kleykamp

[11] Patent Number: 4,601,245

[45] Date of Patent: Jul. 22, 1986

[54] HOLDDOWN BAR FOR A HATCH COVER OF A RAILROAD CAR

[75] Inventor: Donald L. Kleykamp, Washington Township, Montgomery County, Ohio

[73] Assignee: Dayco Corporation, Dayton, Ohio

[21] Appl. No.: 459,273

[22] Filed: Jan. 19, 1983

[51] Int. Cl.[4] ..... B61D 39/00

[52] U.S. Cl. ..... 105/377; 49/475

[58] Field of Search ..... 16/86 A, 228, 273, 285, 16/286; 49/489, 490, 491, 492, 493, 475, 488; 52/45, 49, 51, 52, 55, 200, 309.16, 403, 471, 716, 717, 718; 105/377; 248/500, 507; 285/112, 330, 425; 292/241, 256.5; 403/338; 114/201 R

[56] References Cited

U.S. PATENT DOCUMENTS

| | | | |
|---|---|---|---|
| 771,133 | 9/1904 | Edwards | 49/488 |
| 1,986,701 | 1/1935 | Zimmermann | 49/488 |
| 2,082,668 | 6/1937 | Vanderveld | 52/717 |
| 2,264,243 | 11/1941 | Knuth | 52/717 X |
| 3,082,022 | 3/1963 | Moore | 285/330 X |
| 3,645,573 | 2/1972 | Strang | 292/241 |
| 3,664,270 | 5/1972 | Stark et al. | 105/377 |
| 3,897,967 | 8/1975 | Barenyi | 52/718 X |
| 4,239,008 | 12/1980 | Conlon | 105/377 |
| 4,320,161 | 3/1982 | Redman | 52/716 X |
| 4,378,742 | 4/1983 | Saylor et al. | 292/256.5 X |
| 4,447,989 | 5/1984 | Mailand et al. | 49/488 |
| 4,452,150 | 6/1984 | Dominguez | 105/377 |

FOREIGN PATENT DOCUMENTS

| | | | |
|---|---|---|---|
| 336734 | 5/1930 | United Kingdom | 49/488 |

OTHER PUBLICATIONS

Admitted prior art to applicant of copending patent application, Ser. No. 412,416, filed Aug. 27, 1982—Clark et al.

*Primary Examiner*—Robert B. Reeves
*Assistant Examiner*—Dennis C. Rodgers
*Attorney, Agent, or Firm*—Joseph V. Tassone

[57] ABSTRACT

A holddown bar for a hatch cover of a railroad car or the like and a railroad car utilizing such a holddown bar are provided, the holddown bar having opposed sides and opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover, the holddown bar having a rain shield secured to one of the opposed sides thereof at the medial portion and opposed ends thereof so as to be adapted to be disposed adjacent and outboard of an end of the hatch cover for protecting the same from the elements. The rain shield comprises a one-piece member formed of a relatively flexible polymeric material.

3 Claims, 28 Drawing Figures

HOLDDOWN BAR FOR A HATCH COVER OF A RAILROAD CAR

BACKGROUND OF THE INVENTION

1. Field of the Invention

This invention relates to an improved holddown bar for a hatch cover of a railroad car or the like and to a railroad car utilizing such a holddown bar.

2. Prior Art Statement

It is known to applicant to provide a holddown bar for a hatch cover of a railroad car or the like, the holddown bar having opposed sides and opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover, the holddown bar having a rain shield secured to one of the opposed sides thereof at the medial portion and opposed ends thereof so as to be adapted to be disposed adjacent and outboard of an end of the hatch cover for protecting the same from the elements.

For example, see FIGS. 1-12 of this application which disclose part of the subject matter of the copending patent application, Ser. No. 412,416, filed Aug. 27, 1982.

SUMMARY OF THE INVENTION

It is one feature of this invention to provide an improved holddown bar for a hatch cover of a railroad car or the like wherein the holddown bar carries an improved rain shield.

In particular, it was found according to the teachings of this invention that a relatively flexible rain shield can be secured to a holddown bar of any of the prior known types disclosed in the copending patent application Ser. No. 412,416, filed Aug. 27, 1982, to permit the same to provide greater protection against the elements by substantially conforming to the contour of the area to be sealed during movement of the railroad car carrying the same.

For example, one embodiment of this invention provides a railroad car having a surface provided with a pair of hatch covers respectively covering a pair of hatch openings in the surface and a pair of like holddown bars respectively for the hatch covers, each holddown bar having opposed sides and opposed ends one of which is pivotally mounted to the surface of the car and the other of which is releasably latched to the surface of the car while a medial portion thereof intermediate the opposed ends extends across its respective hatch cover and carries a sealing gasket in a channel thereof that engages against its respective hatch cover. Each holddown bar has a rain shield secured to one of the opposed sides thereof at the medial portion and opposed ends thereof and is disposed adjacent and outboard of an end of its respective hatch cover for protecting the same from the elements. Each rain shield comprises a one-piece member formed of a relatively flexible polymeric material and has an edge that is flexed against the surface and thereby substantially conforms to the contour of the surface to substantially seal the rain shield against the surface. Each holddown bar and its respective rain shield respectively have securing parts that secure the same together, the securing parts of each holddown bar comprising a plurality of spaced apart like projections extending outwardly from both of the sides thereof at the medial portion and the opposed ends thereof whereby the rain shields are secured to different sides of the holddown bars.

Accordingly, it is an object of this invention to provide an improved holddown bar for a hatch cover of a railroad car or the like, the holddown bar of this invention having one or more of the novel features of this invention as set forth above or hereinafter shown or described.

Another object of this invention is to provide an improved railroad car having a holddown bar of this invention, the railroad car of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 16 is a view similar to FIG. 15 and illustrates the holddown bar having the rain shield thereof flexed by a railroad car or the like.

DESCRIPTION OF THE PREFERRED EMBODIMENTS

Figure 1:
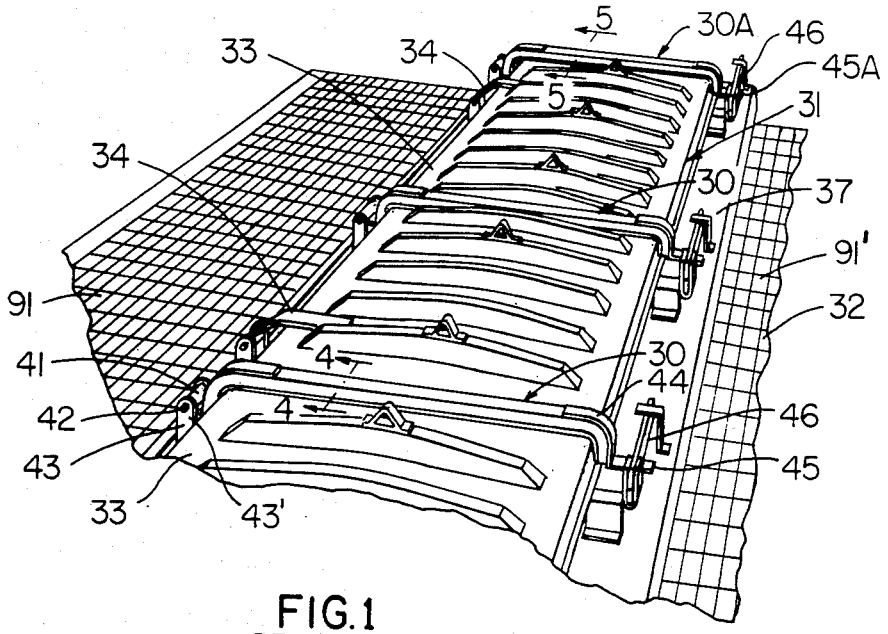
FIG. 1 PRIOR ART
FIG. 1 is a fragmentary top perspective view of a railroad car having holddown bars for the hatch covers thereof, FIG. 1 illustrating prior art holddown bars.

While the various features of this invention are hereinafter illustrated and described as providing a holddown bar for a certain type of hatch cover of a railroad car, it is to be understood that the various features of this invention can be used singly or in any combination thereof to provide a holddown bar for other structures as desired.

Therefore, this invention is not to be limited to only the embodiments illustrated in the drawings, because the drawings are merely utilized to illustrate one of the wide variety of uses of this invention.

It is believed that in order to fully describe the various features of this invention, a detailed disclosure of the prior art structure should be first set forth.

Figure 2:
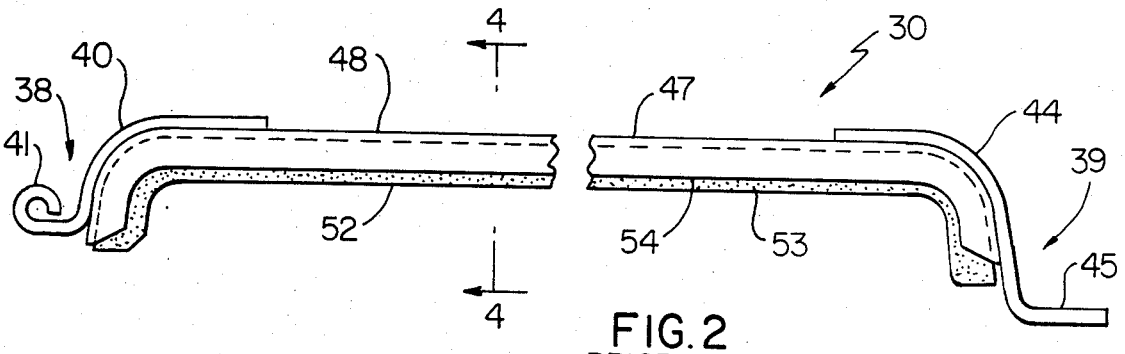
FIG. 2 PRIOR ART
FIG. 2 is an enlarged side view of one of the prior art holddown bars of FIG. 1.
Figure 3:
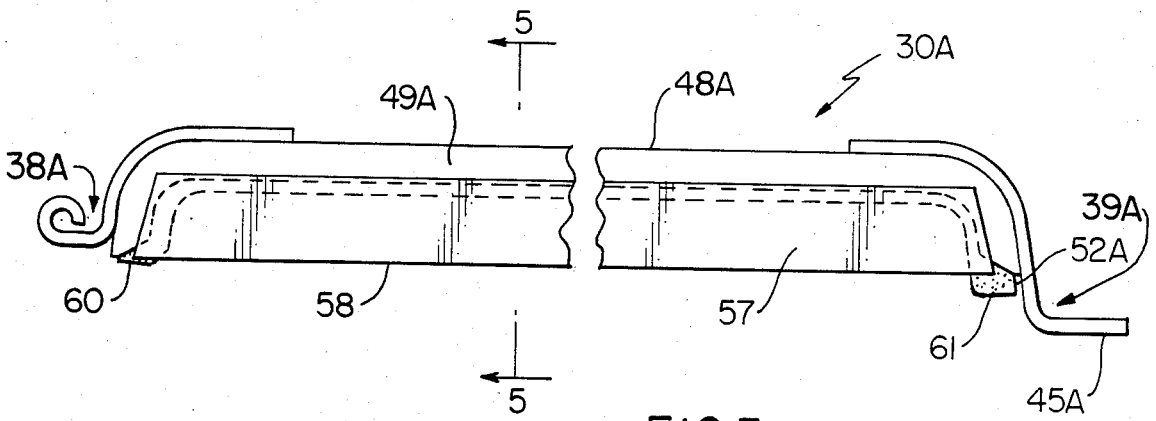
FIG. 3 PRIOR ART
FIG. 3 is an enlarged side view of another of the prior art holddown bars of FIG. 1.
Figure 4:
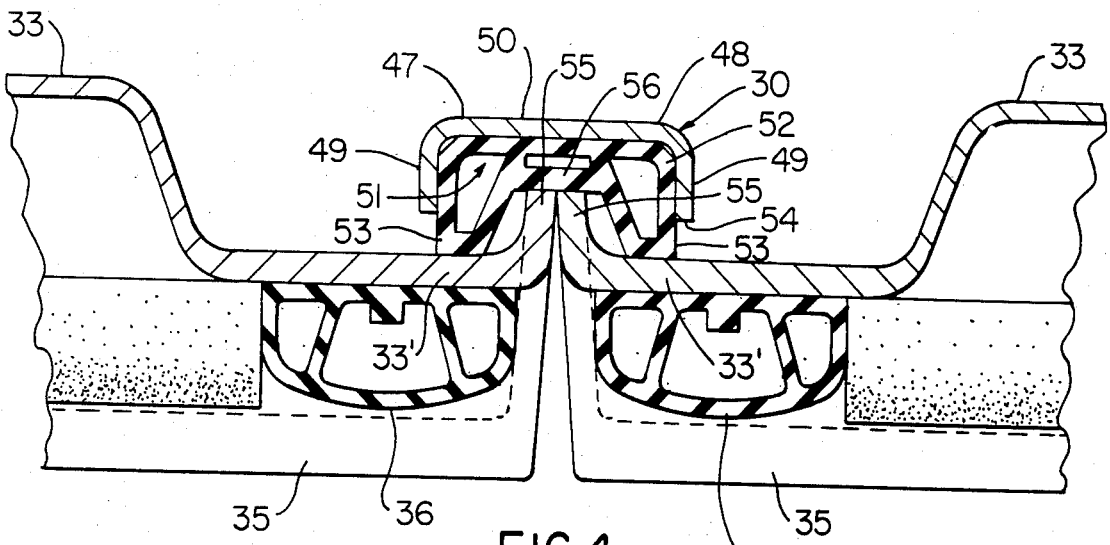
FIG.4 PRIOR ART
FIG. 4 is an enlarged fragmentary cross-sectional view taken on line 4—4 of FIG. 2 as well as on line 4—4 of FIG. 1.
Figure 5:
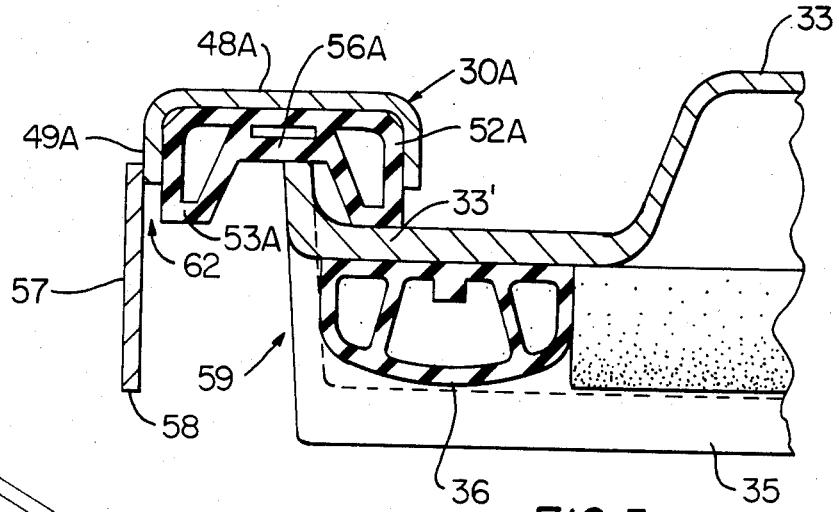
FIG.5 PRIOR ART
FIG. 5 is an enlarged fragmentary cross-sectional view taken on line 5—5 of FIG. 3 as well as on line 5—5 of FIG. 1.

Accordingly, referring now to FIGS. 1–5, one prior known holddown bar for a hatch cover of a railroad car is generally indicated by the reference numeral 30 in FIGS. 1, 2 and 4 while another prior known holddown bar is generally indicated by the reference numeral 30A in FIGS. 1, 3 and 5, the prior known holddown bars 30 and 30A being illustrated in FIG. 1 as holding closed the hatch cover unit 31 of a conventional railroad car 32.

The hatch cover unit 31 of the railroad car 32 comprises two like hatch covers 33 disposed in aligned relation and each being pivotally mounted to the car 32 by hinges 34 in a manner conventional in the art.

Each hatch cover 33 has a peripheral flange means 35 carrying sealing gaskets 36 which are adapted to be disposed in sealing relation against the hatch opening flange 37 and be held in sealing engagement therewith by the holddown bars 30 and 30A in a manner well known in the art to fully close the hatch opening (not shown) in the top of the railroad car 32.

The prior known holddown bar 30 has opposed ends 38 and 39 with the end 38 comprising a metal plate 40 that is formed to define a tubular part 41 that is adapted to be pivotally mounted to a pivot pin 42 of a bracket 43 carried by the railroad car 32 in a manner well known in the art whereby the holddown bars 30 are adapted to pivot on the pivot pin 42 and between the upstanding side flanges 43′ of the bracket 43.

Each prior known holddown bar 30 has the other end 39 thereof formed from a metal plate 44 so shaped that the same defines a toe or latch plate 45 which is adapted to be releasably latched to the car 32 by suitably latch member 46 extending over the same as illustrated in FIG. 1 in a manner well known in the art whereby a medial portion 47 of the holddown bar 30 will extend across the respective hatch cover 33 or covers 33 to sealingly engage thereagainst and hold the respective hatch cover 33 or covers 33 in sealing relation against the hatch opening flange 37 of the railroad car 32 in a manner well known in the art.

The medial portion 47 of each holddown bar 30 comprises a metal channel member 48 having a pair of spaced parallel legs 49 and a cross member 50 that define a channel 51 which receives a resilient sealing gasket 52 therein which has side portions 53 that extend outboard of the bottom edges 54 of the legs 49 of the U-shaped channel member 48 as illustrated in FIGS. 2 and 4 so as to sealingly engage directly against the hatch cover 33 or covers 33. For example, FIG. 4 illustrates the holddown bar 30 spanning and engaging the adjacent upstanding end flanges 55 at the adjacent ends 33′ of the hatch covers 33 with a central section 56 of the gasket 52 while the side portions 53 of the gasket 52 sealingly engage against the respective covers 33 inboard of the flanges 55 thereof as illustrated in FIG. 4. In this manner, not only are the adjacent ends 33′ of the two hatch covers 33 held in a sealing closed condition against the hatch opening flange 37 by the holddown bar 30 of FIG. 4, but also the gasket 52 of the holddown bar 30 seals the adjacent flanges 55 to each other.

As illustrated in FIG. 1, at least one other holddown bar 30 is provided on the railroad car 32 for each hatch cover 33 and is disposed intermediate the opposed ends 33′ of the respective hatch cover 33 to engage against such hatch cover 33 and hold the same in its closed condition against the hatch opening flange 37.

The metal end plates 40 and 44 that define the opposed ends 38 and 39 of each holddown bar 30 are secured to the metal channel member 48, such as by welding or the like, and the sealing gasket 52, which is formed of rubber or the like, is secured in the channel 51 of the channel member 48 by a suitable adhesive or the like. The surfaces of the metal parts of the holddown bar can be provided with protective coatings or the like.

Each holddown bar 30A is formed in substantially the same manner as the holddown bar 30 previously described whereby like parts are indicated by like reference numerals followed by the reference letter "A".

As illustrated in FIGS. 3 and 5, each holddown bar 30A is formed identical to the holddown bar 30 previously described except that the same has a metal side plate 57 welded to the particular leg 49A of the channel member 48A so as to have its lower edge 58 extend closely adjacent the hatch flange 37 of the car 32 as illustrated in FIG. 5 so as to tend to protect the particular end 33′ of the hatch cover 33 that is exposed to the elements at each end of the railroad car 32 in the area of the reference numeral 59 in FIG. 5 whereby the two end holddown bars 30A for each railroad car 32 have the side plates 57 on different legs 49A of their respective channel member 48A. Such side plate 57 is hereinafter referred to as a "rain shield" but it is of course to be understood that the same shields the protected hatch even from other elements of the weather than just rain.

However, it was found according to the teachings of the invention set forth in the copending patent application, Ser. No. 412,416, filed Aug. 27, 1982, that not only are the opposed ends 60 and 61 of the gasket 52A of each holddown bar 30A exposed to the elements as illustrated in FIG. 3 even though the side plate 57 is being utilized, but also the sealing gasket 52A of each holddown bar 30A as illustrated in FIG. 5 has an area in the region of the reference numeral 62 subjected to wind, ice, snow, etc. which tend to start gasket tear and, thus, early wear out of the sealing gasket 52A. In addition, it is believed that the sharp metal edges on the U-shaped channel member 48A tend to cause cutting of the gasket 52A and, thus, also early wear out thereof.

It can readily be seen from FIG. 1 that the hatch covers 33 are adapted to be latched in the closed position by the holddown bars 30 and 30A having the latch toes 45 and 45A thereof held in the latched position by the latches 46 whereby the sealing gaskets 36 of the covers 33 are held in sealing relation against the hatch opening flange 37 until it is desired to open the hatch covers 33.

In particular, in order to open a particular hatch cover 33, the latches 46 for the holddown bars 30 and 30A for that particular hatch cover 33 are opened so that the holddown bars 30 and 30A can be pivoted on their pivot ends 38 at the brackets 43 in a manner to be out of the way of the particular hatch cover 33 so that that particular hatch cover 33 can be opened on its hinge structure 34 in a manner conventional in the art.

Figure 6:
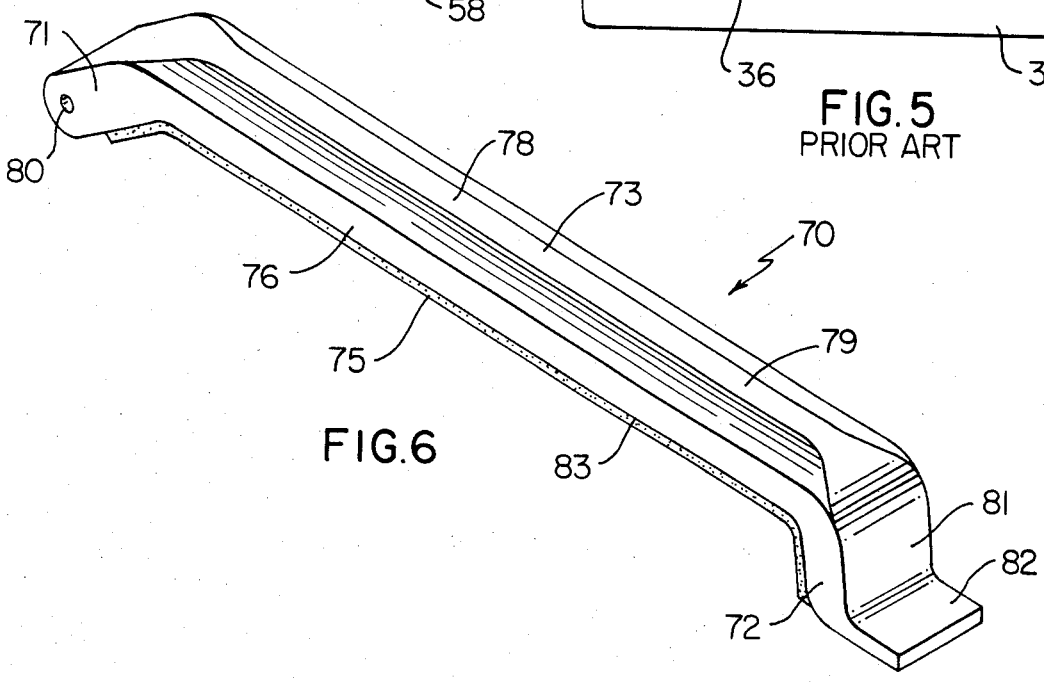
FIG. 6 is a top perspective view of one of the improved prior known holddown bars of the invention of the copending patent application, Ser. No. 412,416, filed Aug. 27, 1982.

As previously stated, it was found according to the teachings of the invention set forth in the copending patent application, Ser. No. 412,416, filed Aug. 27, 1982, that the prior known substantially all metal holddown bars 30 and 30A can be replaced by the uniquely formed holddown bars of that invention that are generally indicated by the reference numeral 70 in FIG. 6 and 70A in FIG. 11, the holddown bars 70 of FIG. 6 to replace the intermediate holddown bars 30 of FIG. 1 and the holddown bars 70A of FIG. 11 to replace the holddown bars 30A of FIG. 1 as will be apparent hereinafter whereby this copending patent application, Ser. No. 412,416, filed Aug. 27, 1982 is being incorporated into this disclosure by this reference thereto. However, sufficient details of the holddown bars of such copending application will now be described in this application in order to fully understand the improved features of this invention.

In particular, the holddown bars 70 and 70A respectively have opposed ends 71, 72 and 71A, 72A integrally and respectively interconnected together by medial portions 73 and 73A, the medial portions 73 and 73A, as well as at least part of the respective opposed ends 71, 72 and 71A, 72A, being so constructed that the same define channels 74 and 74A therein that receive the resilient sealing gaskets 75 and 75A which are disposed between pairs of spaced apart substantially parallel legs 76 and 76A.

The holddown bars 70 and 70A are made from a relatively rigid polymeric material and are formed, such as by molding, so that the opposed ends 71, 72 and 71A, 72A, as well as the medial portions 73 and 73A thereof, respectively comprise one-piece members that form the unique configurations illustrated in the drawings.

In particular, the medial portions 73 and 73A of the holddown bars 70 and 70A are substantially straight with the top portions 78 and 78A thereof each having a substantially trapezoidal cross-sectional configuration so as to provide substantially streamlined top surfaces 79 and 79A of the respective holddown bars 70 and 70A, as well as added strength to the medial portions 73 and 73A thereof.

Figure 8:
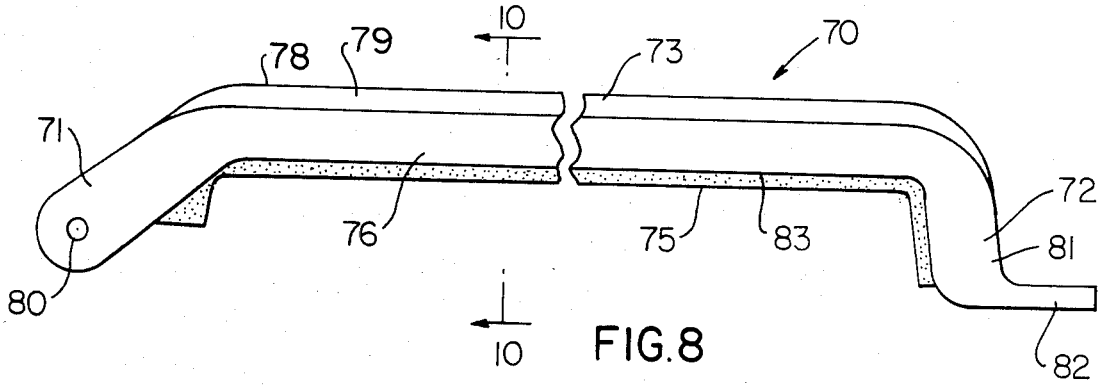
FIG. 8 is a side view of the holddown bar of FIG. 7.
Figure 9:
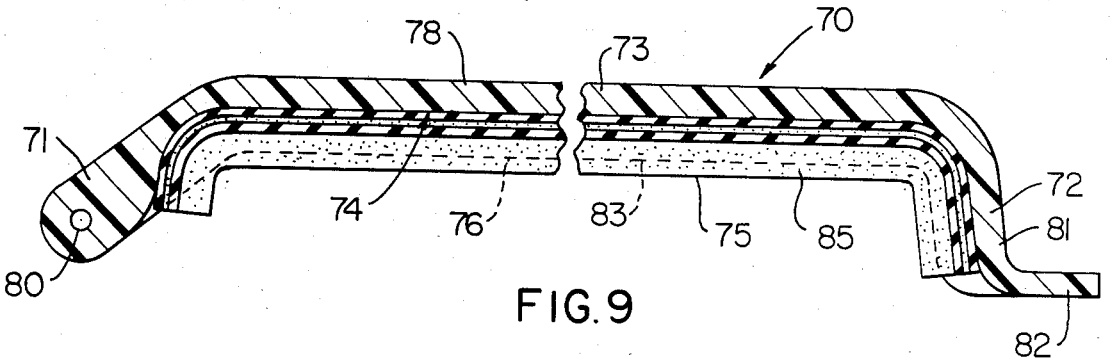
FIG. 9 is a cross-sectional view taken on line 9—9 of FIG. 7.
Figure 11:
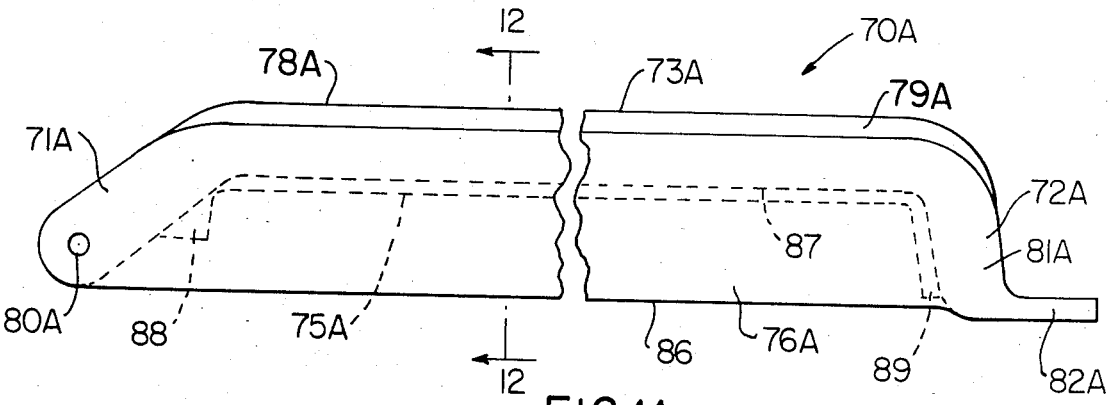
FIG. 11 is a side view of another improved prior known holddown bar of the invention of the aforementioned copending patent application.

The ends 71 and 71A of the respective holddown bars 70 and 70A are substantially straight and are respectively disposed at obtuse angles relative to to the respective medial portions 73 and 73A as illustrated respectively in FIGS. 8 and 11.

In this manner, the ends 71 and 71A of the holddown bars 70 and 70A respectively have the same width as the pair of legs 76 and 76A as well as provide relatively large masses of material to have the respective pivot holes 80 and 80A passing therethrough for respectively receiving the pivot pins 42 of the brackets 43 of the railroad car 32 when the same are utilized to replace the holddown bars 30 and 30A as previously described.

Figure 7:
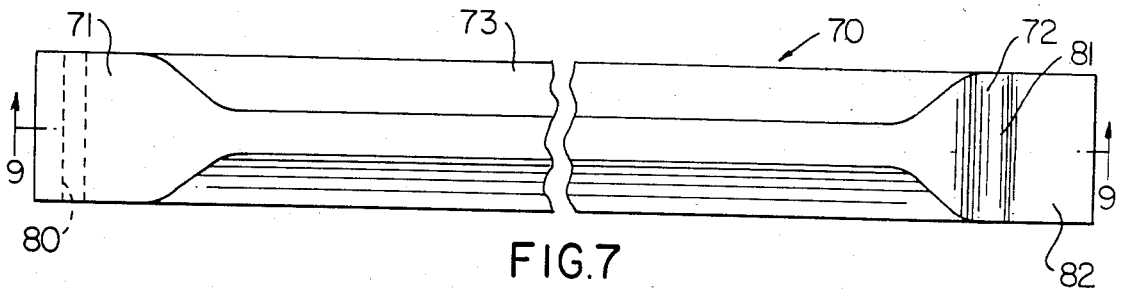
FIG. 7 is a top view of the holddown bar of FIG. 6.

The other ends 72 and 72A of the respective holddown bars 70 and 70A are substantially L-shaped and are defined by a pair of legs 81, 82 and 81A, 82A that join each other substantially at a right angle while the legs 81 and 81A respectively join the medial portions 73 and 73A substantially at right angles as illustrated respectively in FIGS. 8 and 11. The ends 72 and 72A are substantially the same width as the ends 71 and 71A previously described whereby the overall top view configurations of the holddown bars 70 and 70A of that invention are substantially rectangular as illustrated in FIG. 7.

Figure 10:
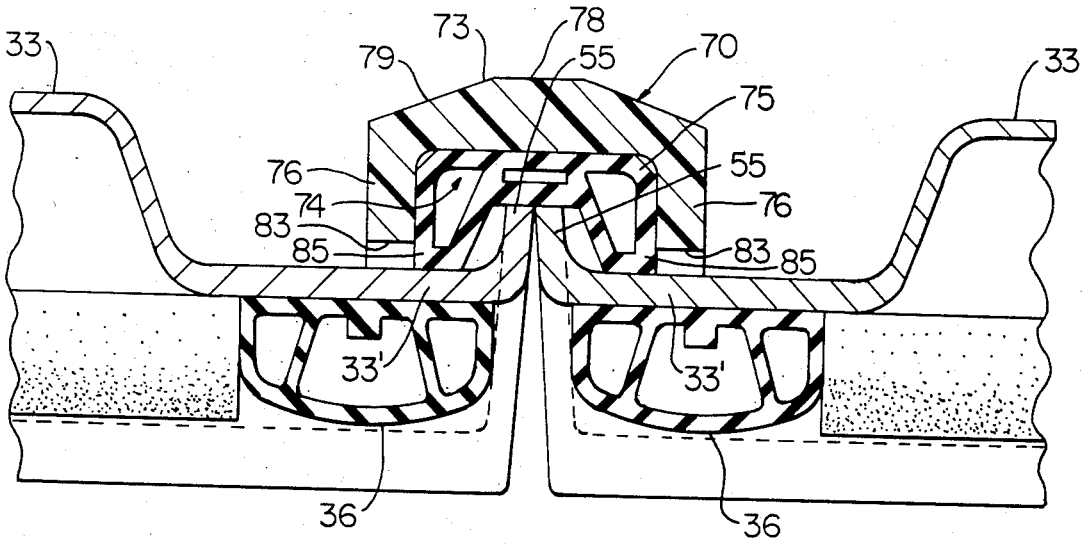
FIG. 10 is an enlarged fragmentary cross-sectional view taken on line 10—10 of FIG. 8 and illustrates the holddown bar in combination with hatch covers in a manner similar to FIG. 4.
Figure 12:
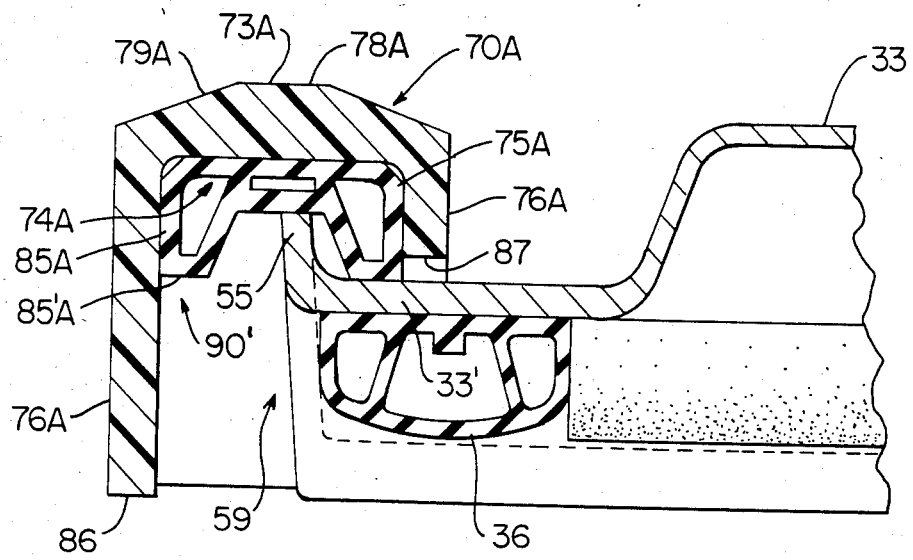
FIG. 12 is an enlarged fragmentary cross-sectional view taken on line 12—12 of FIG. 11 and illustrates the holddown bar in combination with a hatch cover in a manner similar to FIG. 5.

As illustrated in FIG. 10, the legs 76 of the holddown bar 70 respectively have bottom edges 83 which are disposed substantially coplanar with each other while the side portions 85 of the gasket 75 extend outboard of the end edges 83 whereas in contrast the bottom edges 86 and 87 of the legs 76A of the holddown bar 70A are disposed in offset relation so that the bottom edge 86 of the longer leg 76A will extend closely adjacent the hatch opening flange 37 of the railroad car 32 as illustrated in FIG. 12 to protect the end area 59 of the adjacent end 33' of the hatch cover 33 in a believed to be more effective manner than the side plate 57 of the holddown bar 30A previously described whereby the longer leg 76A comprises a "rain shield".

In particular, it can readily be seen in FIG. 11 that the longer leg 76A has its bottom edge 86 disposed so that the same fully protects the opposed end portions 88 and 89 of the gasket 75A whereas it can readily be seen in FIG. 3 that the opposed ends 60 and 61 of the gasket 52A are exposed to the elements below the bottom edge 58 of the side plate 57 thereof.

In addition, it can readily be seen in FIG. 12 that the longer leg 76A of the holddown bar 70A is fully disposed against the sealing gasket 75A all the way to the bottom edge 85'A of the adjacent portion 85A thereof so that wind, dirt, sleet, etc. cannot enter between the longer leg 76A and the gasket 75A in the region of the reference numeral 90' whereas in contrast it can readily be seen in FIG. 5 that wind, dirt, sleet, etc. can enter into the region indicated by the reference numeral 62 to attack the lower free end 53A of the sealing gasket 52A to begin a tear area therein as previously described. However, it is believed that the improved rain shield of this invention will overcome this problem if the improved rain shield of this invention is utilized with the holddown bar 30 as will be apparent hereinafter.

As previously stated, the holddown bars 70 and 70A can be formed from any suitable relatively rigid polymeric material that can be molded into the configurations illustrated and the gaskets 75 and 75A can be subsequently and respectively adhesively secured in the channels 74 and 74A to perform a sealing function with the flanges 55 of the hatch covers 33 as well as against points thereon inboard of the flanges 55 as illustrated respectively in FIGS. 10 and 12.

For example, the relatively rigid polymeric material for forming the holddown bars 70 and 70A can be an ultra high molecular weight synthetic plastic material, such as nylon, polyethylene, urethane, etc., having a molecular weight of between two million and six million. For example, such an ultra high molecular weight polyethylene material and a method of molding the same is disclosed in the U.S. patent to Cooper et al, No. 4,238,039 whereby this patent is being incorporated into this disclosure by this reference thereto. Also, such polymeric material for the holddown bars 70 and 70A could be reinforced, such as is disclosed in this patent to Cooper et al or in the manner set forth in the copending patent application, Ser. No. 456,154, filed Jan. 6, 1983, whereby this copending patent application is being incorporated into this disclosure by this reference thereto.

Accordingly, it can be seen that it is a relatively simple method to form the holddown bars 70 and 70A, such as by a simple molding operation, so that the same are substantially one-piece members that readily replace the holddown bars 30 and 30A of the railroad car 32 illustrated in FIG. 1 as the ends 71 and 71A thereof readily permit the same to be pivotally mounted on the pivot pins 42 of the brackets 43 and the legs 82 and 82A of the ends 72 and 72A readily accept the latches 46 to permit latching of the holddown bars 70 and 70A with their medial portions 73 and 73A extending across the hatch covers 33 in such a manner that the sealing gaskets 75 and 75A thereof will seal and hold against the hatch covers 33 so that their respective sealing gaskets 36 will readily seal against the hatch opening flange 37 in the manner previously described.

However, it has been found that the holddown bars 70 and 70A are approximately sixty percent lighter than their steel counterparts 30 and 30A whereby a weight gain advantage of approximately 35 pounds per railroad car 32 is provided when the holddown bars 70 and 70A are substituted for the holddown bars 30 and 30A and such railroad car 32 had two holddown bars 30A and three holddown bars 30.

It is also believed that the holddown bars 70 and 70A are four times more wear resistant than the stainless steel counterpart holddown bars 30 and 30A.

Since the holddown bars 70 and 70A have less weight than their steel counterparts 30 and 30A, it is believed that the holddown bars 70 and 70A will not overload their respective gaskets 75 and 75A, as well as the gaskets 36 of the hatch covers 33, so as to permit the gaskets to maintain their sealing resilience for a longer period of time.

In addition to the chemical resistance and no-rust properties of the polymeric material of the holddown bars 70 and 70A, the polymeric material thereof is compatible with the plastic material that normally forms the hatch covers 33. This is particularly important because it has been found that as railroad cars 32 vibrate, twist and torque, the weight and pressure of a steel holddown bar, with its alien physical properties, can cause undue wear and cracks in the hatch covers 33. Since hatch cover replacements are costly, it is believed that by utilizing the holddown bars 70 and 70A, since the same have substantially the same expansion, contraction and mechanical characteristics as the hatch covers 33, a major source of stress and wear on the hatch covers 33 will be eliminated.

Since the operation of the holddown bars 70 and 70A are substantially the same as the holddown bars 30 and 30A previously described, it is deemed unnecessary to further describe the operation of the holddown bars 70 and 70A except to state that same can readily replace the holddown bars 30 and 30A.

When the holddown bars 70 and 70A are formed of the aforementioned ultra high molecular weight nylon, and such material was presently the preferred material for the holddown bars 70 and 70A, such material will provide the following characteristics among others: high tensile strength for structural rigidity; maintains its strength over a wide temperature range; heat distortion only occurs at temperatures over 400° F.; has outstanding wear resistance; is approximately seven times lighter than most metals; has excellent chemical resistance; has self-extinguishing flamability characteristics; is ultraviolet resistant; is self-lubricating, such as in the hinge area that is indicated by the reference numerals 42, 43 in FIG. 1; does not rust; and provides no damage to the running boards of the railroad car 32 which are indicated by the reference numeral 91' in FIG. 1.

Therefore, it can be seen that each of the holddown bars of the aforementioned copending patent applications can comprise a one-piece member formed of relatively rigid polymeric material and having or not having reinforcing means therein as desired.

As previously stated, it is a feature of this invention to provide an improved holddown bar of the type set forth in the aforementioned copending patent applications or of the type set forth in FIGS. 1–5 wherein the same has an improved rain shield as provided by the teachings of this invention.

In particular, it is believed according to the teachings of this invention that if the rain shield for the holddown bar carrying the same is formed of a relatively flexible polymeric material, the rain shield will provide better protection against the elements because the rain shield is adapted to flex against the engaged surface of the railroad car carrying the same so as to conform to the contour thereof even though subsequent relative movement is being provided between the holddown bar and the railroad car during movement of the railroad car whereas in contrast, each of the relatively rigid rain shields of the prior described holddown bars must be spaced from the respective top surface of the railroad car to permit such relative movement therebetween and thereby permits the elements to enter into the space between the rain shield and the end of the hatch cover that is intended to be protected thereby.

Therefore, while the rain shields of this invention are hereinafter illustrated and described as being carried by the holddown bars of the type set forth in the copending patent application, Ser. No. 412,416, filed Aug. 27, 1982, it is to be understood that the rain shields of this invention can be utilized with other types of holddown bars as desired.

Figure 13:
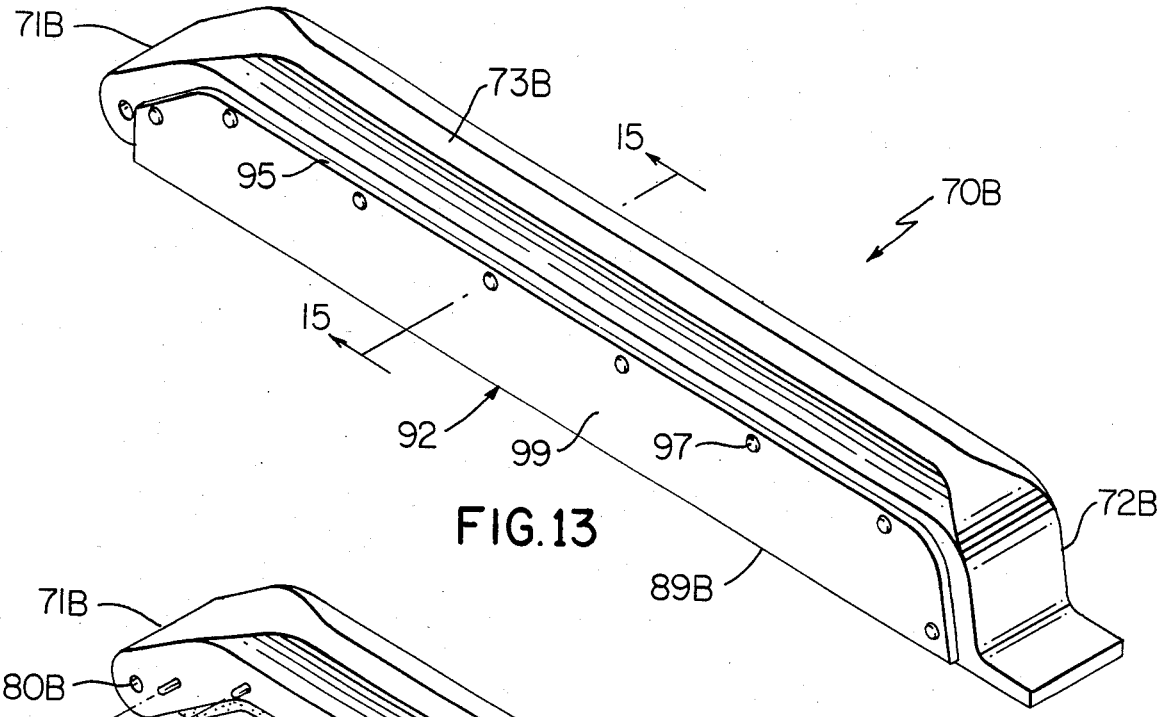
FIG. 13 is a perspective view of an improved holddown bar of this invention.
Figure 14:
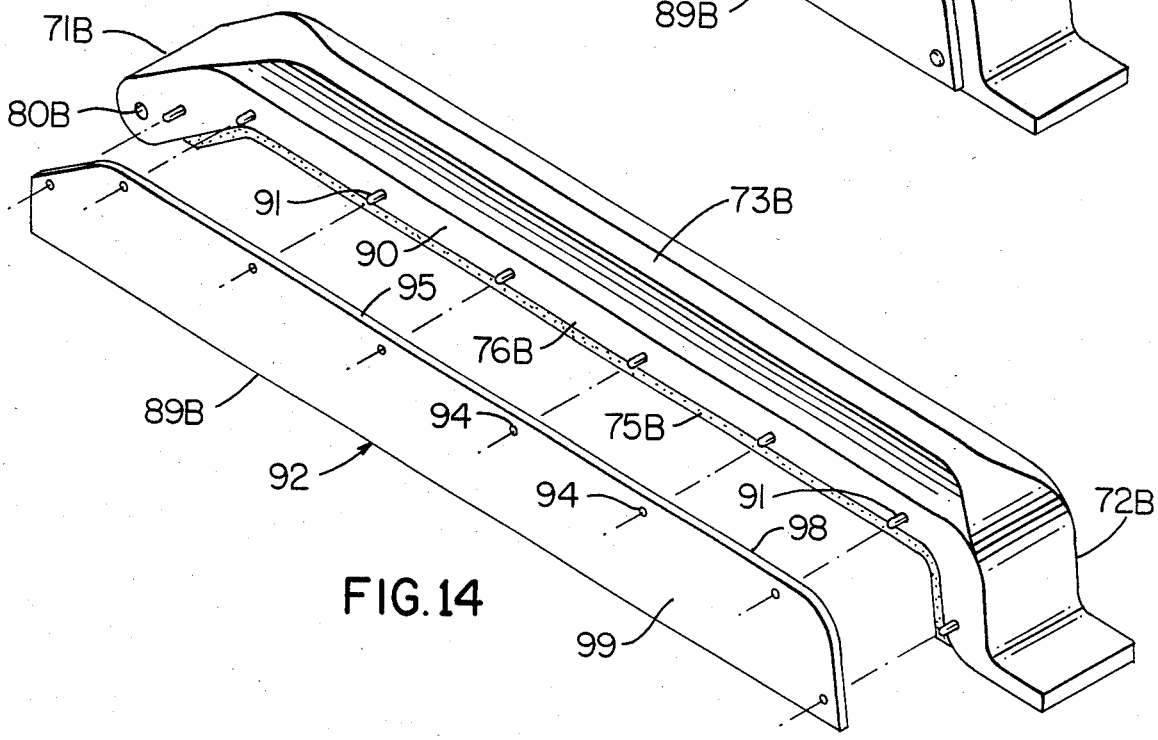
FIG. 14 is an exploded perspective view of the holddown bar of FIG. 13.
Figure 15:
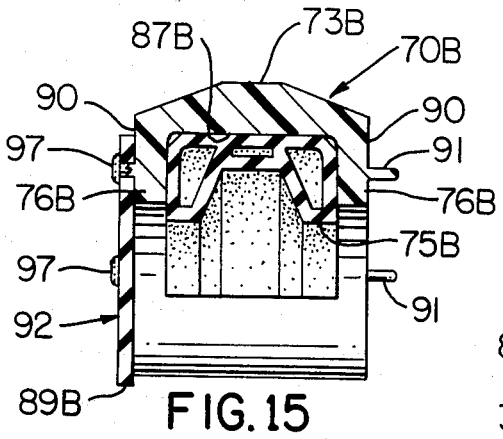
FIG. 15 is a cross-sectional view taken on line 15—15 of FIG. 13.

Accordingly, reference is now made to FIGS. 13–15 wherein an improved holddown bar of this invention is generally indicated by the reference numeral 70B and parts thereof similar to the holddown bars 70 and 70A previously described are indicated by like reference numerals followed by the reference letter "B".

As illustrated in FIGS. 13 and 14, the holddown bar 70B of this invention is substantially the same as the holddown bar 70 of FIG. 8 previously described and thereby comprises a one-piece member formed of relatively rigid polymeric material having or not having reinforcing means therein and defining opposed ends 71B and 72B interconnected together by a medial portion 73B that defines a channel 87B between a pair of opposed side legs 76B thereof and in which a suitable flexible sealing gasket 75B is secured for the purposes previously described.

The holddown bar 70B has the legs 76B thereof defining substantially flat parallel opposed sides 90, each side 90 being provided with a plurality of outwardly extending spaced apart projections 91 which comprise means for securing to securing parts of a rain shield of this invention that is generally indicated by the reference numeral 92 in a manner hereinafter described.

The rain shield 92 is adapted to be either secured to the right hand side 90 or the left hand side 90 of the holddown bar 70B as desired so as to be on one side or the other thereof depending upon which end of the railroad car the holddown bar 70B is to be utilized so that the rain shield 92 thereof will be disposed adjacent and outboard of the adjacent end of the hatch cover to be protected thereby.

Thus, it can be seen that by having the securing projections 91 on both sides 90 of the holddown bar 70B, the holddown bar 70B of this invention can be utilized at either end of the railroad car or be disposed across the medial portion of one of the hatch covers thereof as desired, it being understood that when a holddown bar 70B of this invention is being disposed across the medial portion of a hatch cover, a rain shield 92 is not utilized therewith.

The rain shield 92 of this invention comprises substantially a flat plate-like member formed of relatively flexible polymeric material, such as natural or synthetic rubber or other polymeric material as desired so that the same will be sufficiently flexible to permit the bottom edge 89B thereof to be adapted to flex and thereby conform to the contour of the surface engaged thereby. For example, see FIG. 16 wherein the bottom edge 89B of the flexible rain shield 92 of the holddown bar 70B of this invention engages against the top surface 93 of the railroad car 32B so as to substantially seal against the same and thereby prevent rain or other weather elements from passing between the lower edge 89B of the rain shield 92 and the surface 93 to reach the gasket 75B of the holddown bar 70B as well as reach the end 33'B of the hatch cover 33B to be protected thereby even though relative movement is being created between the holddown bar 70B and the surface 93 as would be the case when the railroad car 32B is subjected to vibrations and oscillating motion during movement of the railroad car on its roadbed in a manner well known in the art.

Thus, it can be seen that the rain shield 92 of this invention can be disposed spaced from the gasket 75B is substantially the same manner as the rain shield 57 of the holddown bar 30A previously described except that the rain shield 92 of this invention prevents the elements from reaching the gasket 75B in contrast to the rain shield 57 previously described.

The rain shield 92 of this invention has a plurality of spaced apart circular openings 94 passing therethrough substantially adjacent the upper edge 95 thereof and corresponding in number to the projections 91 on each side 90 of the holddown bar 70B, the openings 94 defining the securing parts for the rain shield 92 and being adapted to cooperate with the securing parts 91 of the holddown bar 70B to permit the rain shield 92 to be secured thereto.

Figure 17:
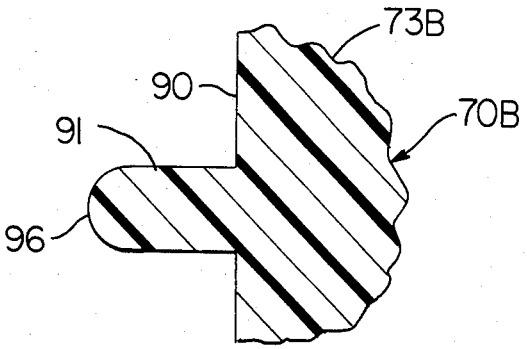
FIG. 17 is an enlarged fragmentary cross-sectional view of the holddown bar illustrated in FIG. 14 and is taken substantially on the line 17—17 thereof.
Figure 18:
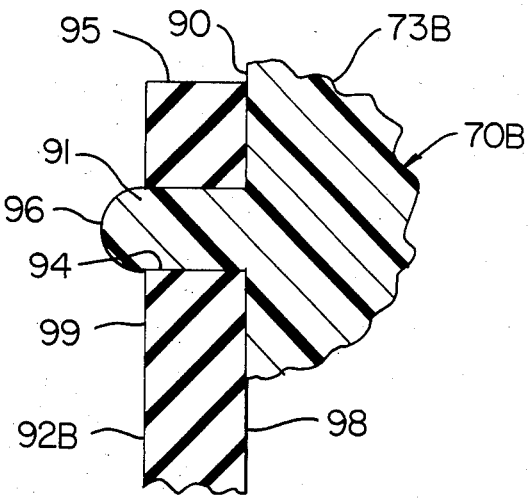
FIG. 18 is a view similar to FIG. 17 and illustrates one step in the method of this invention for securing the rain shield of this invention to the holddown bar of FIG. 17.
Figure 19:
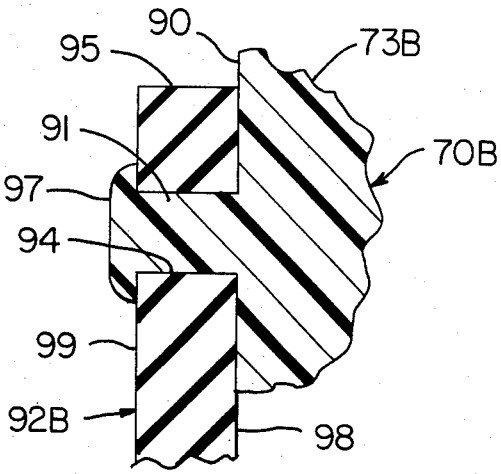
FIG. 19 is a view similar to FIG. 18 and illustrates the final step in securing the rain shield to the holddown bar of FIG. 17.

In particular, it can be seen in FIG. 17 that each projection 91 on the side 90 of the holddown bar 70B is formed integrally therewith, is substantially cylindrical and has a substantially rounded end 96 permitting the same to be readily inserted through a corresponding opening 94 in the rain shield 91 as illustrated in FIG. 18 and thereafter be turned over or reshaped in any suitable manner to form a rivet head 97 disposed against the side 99 of the rain shield 92 as illustrated in FIG. 19 to thereby secure the rain shield 92 to the holddown bar 70B.

Figure 16:
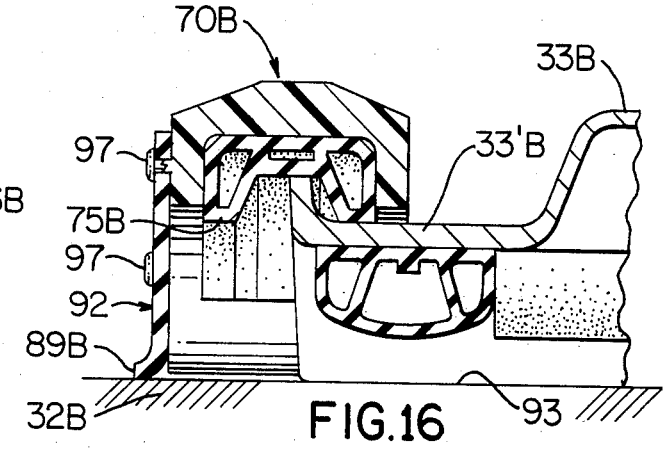

In this manner, the other flat side 98 of the rain shield 92 is disposed flush against the flat side 90 of the holddown bar 70B at the medial portion 73B and opposed ends 71B and 72B thereof so that the lower edge 89B of the rain shield 92 is adapted to flex against the surface 93 of the railroad car 32B to seal against the surface 93 and by conforming to the contour thereof to prevent the elements from reaching the end 33'B of the hatch cover 33B as illustrated in FIG. 16 even though there is relative movement between the rain shield 92 and the surface 93 because the rocking and vibrations of the railroad car 32B during movement thereof for the reasons previously set forth.

While the operation of the holddown bar 70B of this invention is substantially the same as the holddown bars 30A and 70A previously described whereby a further discussion of the operation of the holddown bar 70B of this invention is not necessary, it can be seen that by forming the rain shield 92 of a relatively flexible polymeric material rather than being substantially rigid in the manner of the rain shields 57 and 76A previously described, the holddown bar 70B of this invention provides improved protection of the end 33'B of the hatch cover 33B because the rain shield 92 is adapted to flex and thereby substantially conform to the contour of the surface 93 of the railroad car 92B to sealingly engage against the same. Also the flexing of the rain shield 92 in this manner compensates for any errors in the tolerances between the hinges 80B of the holddown bar 70B and the top surface 93 of the railroad car 32B.

While the projections 91 on the holddown bar 70B of this invention have been illustrated and described as being integral and one-piece with the holddown bar 70B as previously described, it is to be understood that the securing parts for the holddown bars of this invention could be separate parts that are molded into the holddown bar at the opposed flat sides thereof during the forming of the holddown bar or subsequently inserted or otherwise secured thereto, as desired.

Figure 20:
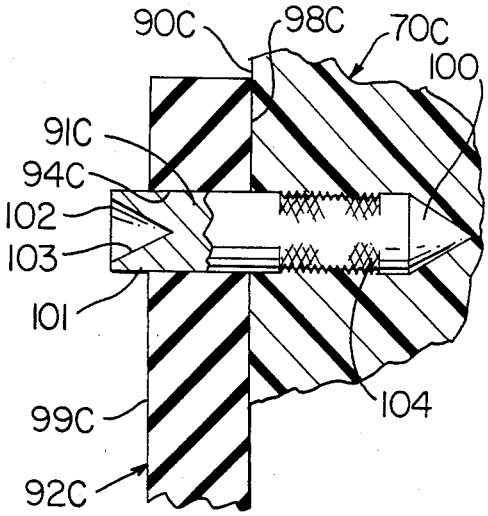
FIG. 20 is a view similar to FIG. 18 and illustrates another holddown bar of this invention.
Figure 21:
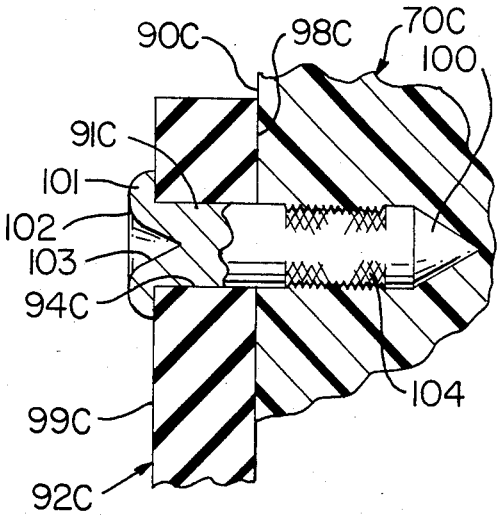
FIG. 21 is a view similar to FIG. 20 and illustrates the final step in the method of this invention for securing the rain shield and holddown bar of FIG. 20 together.

For example, another holddown bar of this invention is generally indicated by the reference numeral 70C in FIGS. 20 and 21 and parts thereof similar to the holddown bars 70A and 70B previously described are indicated by like reference numerals followed by the reference letter "C".

As illustrated in FIGS. 20 and 21, a plurality of projections 91C (only one projection 91C being shown in FIGS. 20 and 21) extend outwardly from the side 90C of the holddown bar 70C with each projection 91C comprising a metallic stud or the like which is substantially cylindrical and provided with a pointed end 100 disposed within the holddown bar 70C while the other end 101 thereof is initially substantially cylindrical with a flat end surface 102 that is interrupted by a conical opening 103 that permits the end 101 to be subsequently flared outwardly in the manner illustrated in FIG. 21 to clamp against the side 99C of the rain shield 92C after the same has its opening 94C receiving the projection 91C therethrough in the manner illustrated in FIG. 20.

If desired, the projection 91C can be provided with a knurled or threaded portion 104 to further assure the securement of the end 100 within the body portion of the holddown bar 70C as illustrated in the drawings, the projections 91C having been secured in the holddown bar 70C during the molding thereof.

While the fastening member 91C for the holddown bar 70C is to have the end 101 thereof subsequently flared against the side 99C of the rain shield 92C to secure the same with its side 98C against the side 90C of the holddown bar 70C as illustrated in FIGS. 20 and 21, it is to be understood that the fastening member 91C can be provided with other means to secure the rain shield 92C to the holddown bar 70C if desired, such as by being provided with a threaded portion to permit a nut to secure the rain shield 92C to the holddown bar 70C in the manner of a nut and bolt arrangement.

Figure 22:
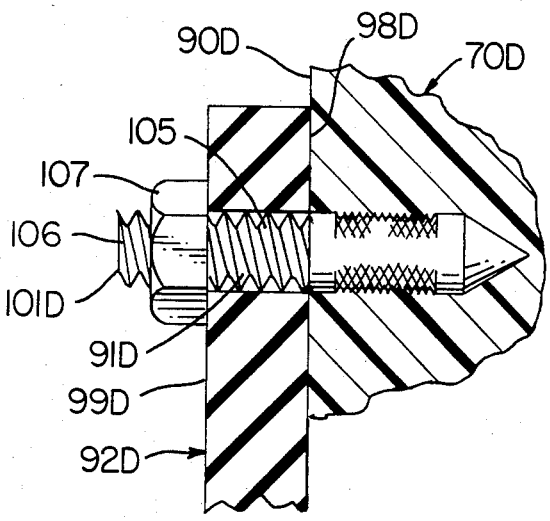
FIG. 22 is a view similar to FIG. 21 and illustrates another holddown bar of this invention.

For example, such a holddown bar of this invention is generally indicated by the reference numeral 70D in FIG. 22 and parts thereof similar to the holddown bar 70C previously described are indicated by like reference numerals followed by the reference letter "D".

As illustrated in FIG. 22, the holddown bar 70D and rain shield 92D are substantially the same as the holddown bar 70C and rain shield 92C previously described except that the studs or projections 91D each has the projecting end 101D thereof provided with external threads 105 so that on the portion 106 of the end 101D of the projection 91D that passes beyond the side 99D of the rain shield 92D, a suitable nut 107 can be threaded thereon to compact against the side 99D of the rain shield 92D and compact the side 98D thereof against the side 90D of the holddown bar 70D so that the rain shield 92C is secured to the holddown bar 70D.

However, it can be seen that in the embodiment illustrated in FIG. 22, the rain shield 92D is adapted to be readily removed from the holddown bar 70D so that a new rain shield 92D can be added thereto should the old rain shield 92D be damaged or be worn out as the case may be.

Of course, it can be seen that the rain shields 92 and 92C previously described could also be removed and replaced by effectively reshaping the turned over portions 97 and 102 of the fastening means 91 and 91C previously described whereby the securing parts of the holddown bars and rain shields of this invention can be made to be readily releasable for removing the rain shields, as desired.

If desired, the rain shield and holddown bar of this invention can be so arranged that the rain shield is adapted to be snap fitted onto the projections of the holddown bar.

Figure 23:
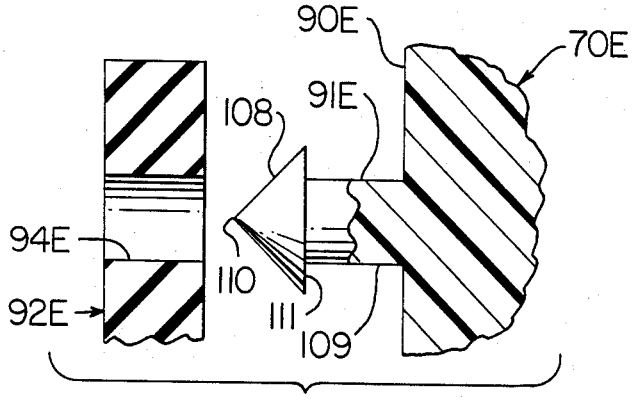
FIG. 23 is a view similar to FIG. 18 and illustrates another holddown bar of this invention, the holddown bar and the rain shield therefor being illustrated prior to the final assembly thereof.
Figure 24:
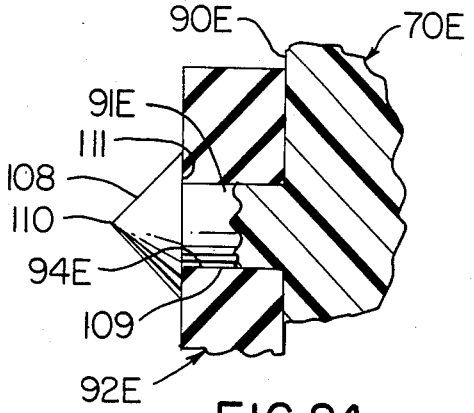
FIG. 24 is a view similar to FIG. 23 and illustrates the rain shield of FIG. 23 completely assembled to the holddown bar of FIG. 23.

For example, reference is now made to FIGS. 23 and 24 wherein another improved holddown bar of this invention is generally indicated by the reference numeral 70E and parts thereof similar to the holddown bars 70A, 70B, 70C and 70D previously described are indicated by like reference numerals followed by the reference letter "E".

It can be seen in FIGS. 23 and 24 that the holddown bar 70E has the plurality of projections 91E extending from the side 90E thereof with each projection 91E having a substantially conical end 108 that is substantially larger than the cylindrical medial portion 109 thereof, the medial portion 109 having a diameter substantially the same as the diameter of the circular opening 94E in the rain shield 92E as illustrated in FIG. 24.

In this manner, the pointed end 110 of the enlargement 108 of the projection 91E is adapted to be forced through the opening 94E in the rain shield 92E because of the flexibility of the rain shield 92E to permit the same to be snapped over the projection 108 onto the reduced portion 109 thereof as illustrated in FIG. 24 so as to be captured between the side 111 of the projection 108 and the side 90E of the holddown bar 70E as illustrated in FIG. 24 so that rain shield 92E is carried by the holddown bar 70E for the purpose previously set forth and is readily removable therefrom by stretching the rain shield 90E at the opening 94E thereof over the enlargements 108 of the projections 91E so that the rain shield 92E can be replaced as desired.

While the openings in the rain shields of this invention have been previously described and illustrated as being substantially circular, it is to be understood that such opening could have other configurations as desired.

For example, another holddown bar of this invention is generally indicated by the reference numeral 70F in FIGS. 25–28 and parts thereof similar to the holddown bars 70A, 70B, 70C, 70D and 70E previously described are indicated by like reference numerals followed by the reference letter "F".

Figure 25:
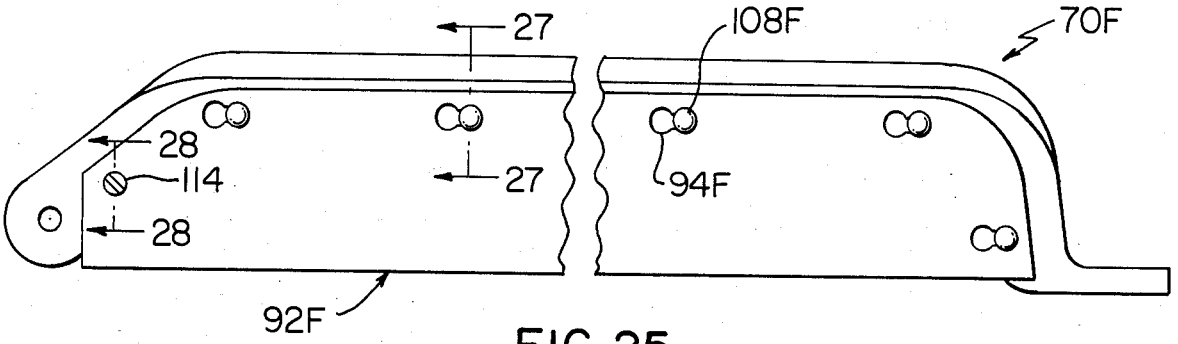
FIG. 25 is a side view of another holddown bar of this invention.
Figure 26:
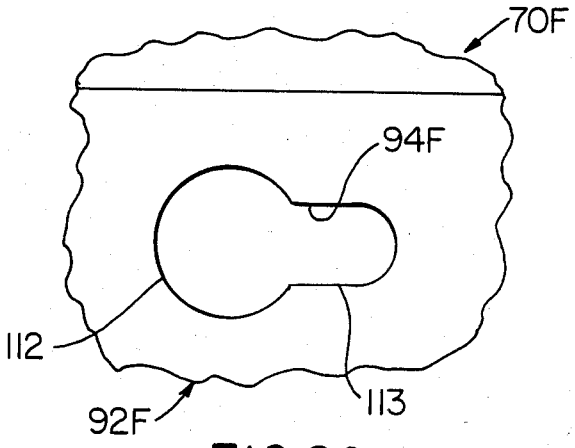
FIG. 26 is an enlarged fragmentary view of the holddown bar of FIG. 25 and illustrates the slot in the rain shield of the holddown bar of FIG. 25.
Figure 27:
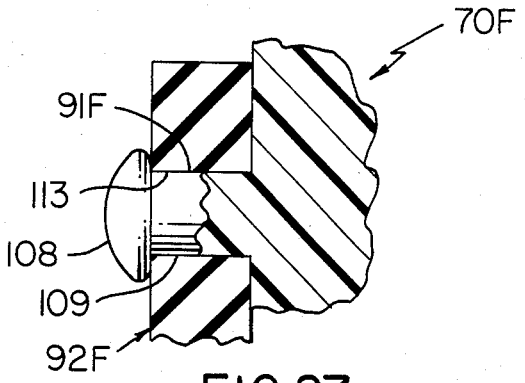
FIG. 27 is an enlarged fragmentary cross-sectional view taken on line 27—27 of FIG. 25.

As illustrated in FIGS. 25 and 26, it can be seen that rain shield 92F of the holddown bar 70F has the openings 94F thereof each shaped in a keyhole configuration as illustrated in FIG. 26 wherein the same has a substantially large circular portion 112 and an elongated narrow portion 113 interconnected thereto, the enlarged circular portion 112 being adapted to readily receive the enlargement 108F of a corresponding projection 91F of the holddown bar 70F therethrough and then permitting the rain shield 92F to be shifted on the projection 91F to receive the reduced portion 109F of the respective projection 91F into the narrow portion 113 thereof as illustrated in FIGS. 25 and 27.

Figure 28:
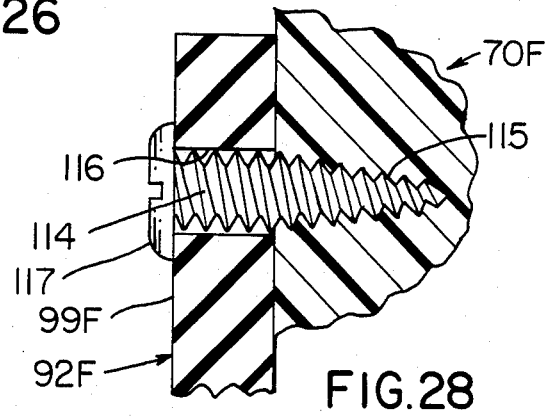
FIG. 28 is an enlarged fragmentary cross-sectional view taken on line 28—28 of FIG. 25.

Accordingly, once the rain shield 92F has been telescoped onto the projections 91F of the holddown bar 70F and then shifted so that the reduced portions 109F of the projections 91F are received in the reduced or narrow portions 113 of the rain shield 92F as illustrated in FIG. 25, the rain shield 92F can be secured in such interlocked position by a single threaded fastening member 114 as illustrated in FIGS. 25 and 28 which has its threaded end 115 threaded into the body portion of the holddown bar 70F as the same passes through a suitable opening 116 in the rain shield 92F to have the enlarged head 117 thereof compact against the side 99F thereof as illustrated in FIG. 28.

Therefore, it can be seen that in all of the holddown bars of this invention previously described, the holddown bar has a plurality of projections onto which the respective rain shield has its openings telescoped so that the same can be subsequently secured thereto by any of the means previously described.

However, it is to be understood that the rain shield of this invention can be secured to its respective holddown bar by parts other than projections of the holddown bar if desired. For example, the rain shield could be releasably secured to the holddown bar merely by a plurality of screws similar to the screw or fastening member 114 previously described. Likewise, the rain shield of this invention could be secured to the holddown bar by any securing part which is compatible for securing a relatively flexible polymeric member to the particular material forming the holddown bar, such as by adhesive, ultrasonic welding, etc.

In any event, it can be seen that the resulting holddown bar of this invention has an improved rain shield because the same is formed from a relatively flexible polymeric material which permits the same to substantially conform to the contour to the surface engaged thereby so as to protect the end of the hatch cover being held in its closed position by the particular holddown bar in the manner previously set forth.

Therefore, it can be seen that this invention not only provides an improved holddown bar for a railroad car or the like, but also the same provides a railroad car utilizing such a holddown bar.

While the forms of this invention now preferred have been illustrated and described as required by the Patent Statute, it is to be understood that other forms can be utilized and still fall within the scope of the appended claims.

What is claimed is:

1. In a railroad car having a surface means provided with a pair of hatch covers respectively covering a pair of hatch openings in said surface means and a pair of like holddown bars respectively for said hatch covers, each said holddown bar having opposed sides and opposed ends one of which is pivotally mounted to said surface means of said car and the other of which is releasably latched to said surface means of said car while a medial portion thereof intermediate said opposed ends extends across its respective hatch cover and carries a sealing gasket means in a channel means thereof that engages against its respective hatch cover, each said holddown bar having a rain shield secured to one of said opposed sides thereof at said medial portion and opposed ends thereof and being disposed adjacent and outboard of an end of its respective hatch cover for protecting the same from the elements, the improvement wherein each said rain shield comprises a one-piece member formed of a relatively flexible polymeric material and having an edge means that is flexed against said surface means and thereby substantially conforms to the contour of said surface means to substantially seal said rain shield against said surface means, each said holddown bar and its respective rain shield respectively have securing means that secure the same together, said securing means of each said holddown bar comprising a plurality of spaced apart like projections extending outwardly from both of said sides thereof at said medial portion and said opposed ends thereof whereby said rain shields are secured to different sides of said holddown bars.

2. A railroad car as set forth in claim 1 wherein said securing means of each said rain shield comprises a plurality of spaced apart openings passing therethrough and respectively receiving said projections of its respective holddown bar therein.

3. A railroad car as set forth in claim 1 wherein said opposed ends, projections and medial portion of each said holddown bar comprise a one-piece member formed of a relatively rigid polymeric material.

* * * * *